US008210370B2

(12) United States Patent
Botkin

(10) Patent No.: US 8,210,370 B2
(45) Date of Patent: Jul. 3, 2012

(54) ARTICULATING MODULAR STORAGE SYSTEM

(76) Inventor: Lance Botkin, Pearland, TX (US)

( * ) Notice: Subject to any disclaimer, the term of this patent is extended or adjusted under 35 U.S.C. 154(b) by 872 days.

(21) Appl. No.: 11/977,070

(22) Filed: Oct. 22, 2007

(65) Prior Publication Data

US 2009/0101613 A1 Apr. 23, 2009

(51) Int. Cl.
*A47F 5/08* (2006.01)

(52) U.S. Cl. ..... 211/117; 211/197; 211/205

(58) Field of Classification Search ..... 211/86.01, 211/197, 117, 116, 113, 196, 205, 85.7, 96–102, 211/13.1, 172, 1.3; 248/200.1, 202.1, 205.1, 248/207, 341; 312/245, 246, 248; 403/70, 403/71, 72, 109.1, 109.6, 150–156, 161
See application file for complete search history.

(56) References Cited

U.S. PATENT DOCUMENTS

| | | | | | |
|---|---|---|---|---|---|
| 1,677,544 | A | * | 7/1928 | Gourley et al. | 312/117 |
| 250,158 | A | | 5/1946 | Rieger | |
| 3,153,527 | A | * | 10/1964 | Giglioli | 248/460 |
| 3,188,033 | A | * | 6/1965 | Groves | 248/188.7 |
| 3,443,782 | A | * | 5/1969 | Fields et al. | 248/188.7 |
| 3,850,533 | A | * | 11/1974 | Thielen | 403/58 |
| 563,206 | A | | 5/1977 | Huong | |
| 4,561,547 | A | | 12/1985 | Estwanik | |
| 4,699,437 | A | * | 10/1987 | Genereaux | 312/248 |
| 570,936 | A | | 1/1988 | Rosen | |
| 4,813,550 | A | | 3/1989 | Sacks | |
| 484,405 | A | | 7/1989 | Hoy | |
| 4,971,593 | A | | 11/1990 | Mayhall | |
| 5,027,960 | A | | 7/1991 | Rainville | |
| 5,044,505 | A | | 9/1991 | Spratt | |
| 5,086,930 | A | | 2/1992 | Sacks | |
| 5,110,076 | A | * | 5/1992 | Snyder et al. | 248/125.3 |
| 5,375,534 | A | * | 12/1994 | Adams | 105/372 |
| 5,377,849 | A | | 1/1995 | Martin | |
| 5,450,697 | A | * | 9/1995 | Prucinsky et al. | 52/210 |
| 5,595,028 | A | * | 1/1997 | Handzlik | 52/32 |
| 5,649,751 | A | * | 7/1997 | Longhurst | 312/242 |
| 5,725,293 | A | * | 3/1998 | Wilkening et al. | 312/248 |
| 5,845,979 | A | * | 12/1998 | Longhurst et al. | 312/246 |
| 5,855,286 | A | | 1/1999 | Zaid | |
| 6,086,481 | A | * | 7/2000 | Li | 472/118 |
| 6,095,344 | A | * | 8/2000 | White | 211/17 |
| 6,138,841 | A | | 10/2000 | Klein | |
| 6,155,440 | A | * | 12/2000 | Arce | 211/118 |
| 6,216,887 | B1 | | 4/2001 | Soo | |
| 6,675,546 | B2 | * | 1/2004 | Coles | 52/655.1 |
| 6,729,478 | B1 | * | 5/2004 | Boers | 211/18 |
| 6,968,658 | B2 | * | 11/2005 | Hales | 52/210 |
| 7,806,280 | B1 | * | 10/2010 | Perkins et al. | 211/100 |
| 2004/0103713 | A1 | * | 6/2004 | Voon et al. | 73/12.04 |
| 2008/0250731 | A1 | * | 10/2008 | Wheeler | 52/167.1 |

* cited by examiner

*Primary Examiner* — Darnell Jayne
*Assistant Examiner* — Andres F Gallego
(74) *Attorney, Agent, or Firm* — William P. Glenn, Jr.; Royston Rayzor Vickery & Williams L.L.P.

(57) ABSTRACT

The present articulating overhead storage device is used to support and store articles such as athletic equipment, sporting goods, clothing, tools upon or in a modular article holder releaseably connected to a spine articularly fixed to an overhead surface. The spine can be move between a generally horizontal and a generally vertical position. In another embodiment, the spine is detachable from the overhead surface and releasably attached to a floor stand.

3 Claims, 3 Drawing Sheets

ARTICULATING MODULAR STORAGE SYSTEM

BACKGROUND OF THE INVENTION

1. Field of the Invention

The present invention relates to storage devices and in particular overhead storage devices.

2. Description of the Related Art

Overhead storage devices are typically constructed, shaped and sized to support a particular type of article, like sports equipment, bicycles or similar type items. Currently a number of such storage devices exist, but fail to provide a means to easily reconfigure for the storage of articles or in different locations. Furthermore, existing overhead storage devices are not capable of being detached from the overhead and utilized as an independent floor or wall based storage device.

What is needed is a sturdy lightweight overhead storage device capable of articulating stored articles from an overhead position to a stacked or vertical position for user access. What is further needed is a sturdy lightweight overhead storage device capable of being detached from the overhead and utilized as an independent floor or wall based storage device.

SUMMARY OF THE INVENTION

An object of the present invention is to provide a sturdy articulating overhead storage device capable of securely holding a variety of articles to a spine of a predetermined length with an upper and lower end regions. In its most basic form, the present invention contemplates an article holder releasably connected to the spine to securely and releasably hold at least a portion of an article, such as athletic equipment, sporting goods, clothing, tools, and/or other articles for storage.

The spine is articularly fixed at its upper end region to an anchor plate which in turn is secured to an overhead surface thereby allowing articulation of the spine between a generally horizontal and a generally vertical position. The lower end region of the spine is releasably fixed to a foundation plate which in turn is secured to an overhead surface. In this configuration, the present invention allows an article or articles to be stored on a spine capable of moving between an overhead and generally horizontal position or hold a variety of articles in a generally vertical position for user access. It is further contemplated that an anchor plate and/or a foundation plate can be secured to a vertical and/or horizontal overhead surfaces, such as a ceiling, rafters, joists, walls, and/or studs.

Yet another related object of the present invention is to allow alternate overhead positioning of an article by providing a spine capable of articulating to a second foundation plate. Another related object of the present invention is to control the articulation of a spine loaded with articles by including a controller that arrests and/or assists the movement of the spine between its storage and vertical positions.

Another object of the present invention is to provide a user with an articulating overhead storage device capable of holding similar or dissimilar articles by providing a variety of article holders in the form of rest, loops, grips, and/or containers that are releasably fixed to a spine.

Another object of the present invention is to allow detachment of the spine for servicing or to simply remove it from the immediate area. Yet another related object of the present invention is to allow the spine to be releasably attached to a base receiver fixed to and projecting up from a floor stand to allow the spine to remain in a generally vertical position when detached from the anchor plate as described above. A further similar object of the present invention is to allow the user to easily move the vertically positioned and detached spine by using a wheeled floor stand. Yet a further similar object of the present invention is to improve user access to article(s) and/or article holder(s) by configuring the spine to rotate about a longitudinal axis. As can be appreciated, the above objectives achieved by the present invention allows a user to gain easy access to an article holder or an article itself.

BRIEF DESCRIPTION OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
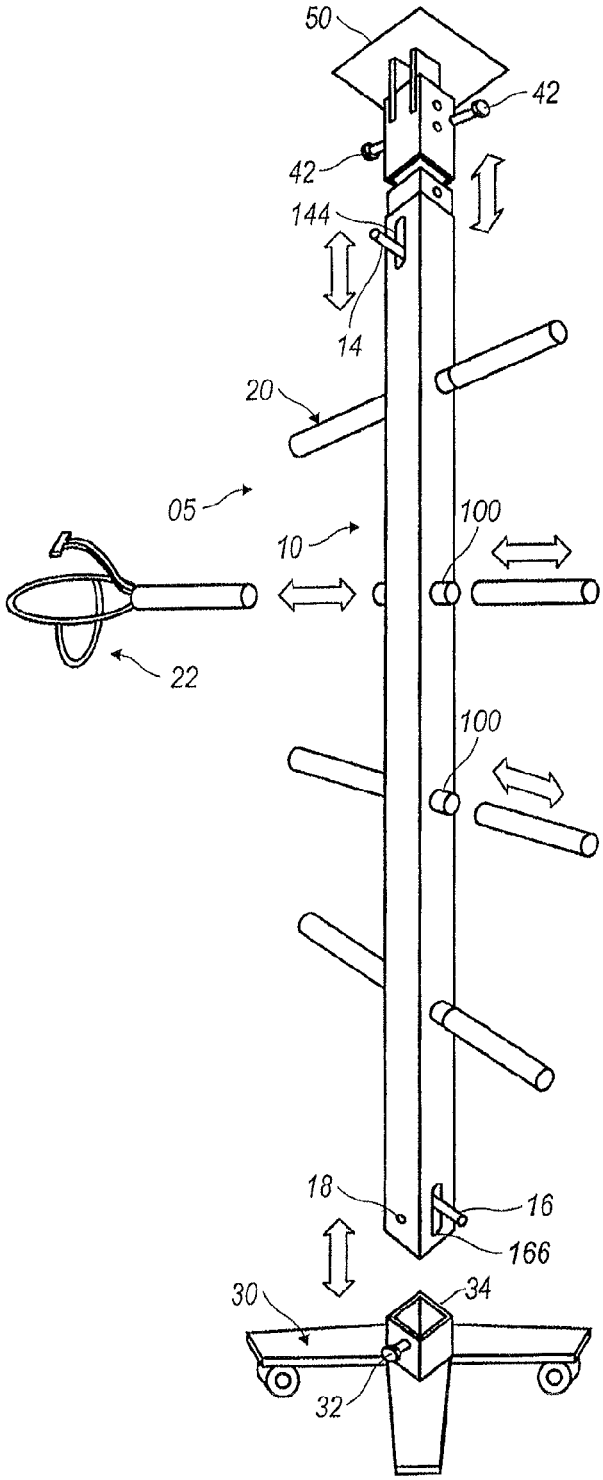
FIG. 1 is a perspective view of an embodiment of the present invention.
Figure 2:
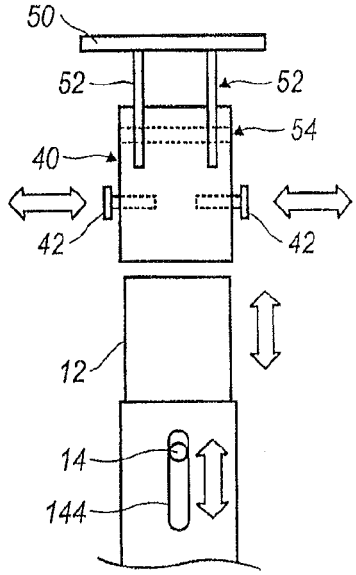
FIG. 2 is a detailed side view of an upper region of an embodiment of the present invention.

The present invention is an articulating overhead storage device 05 which includes a spine 10 with an upper end region and a lower end region. A modular article holder such as a rest 20, spherical holder 22, a pair of rests with holes 24, wire frame basket 26 and/or pivoting basket 28 are releasably fixed to spine 10 by a stub 100 that extends away from spine 10 (See FIGS. 1 and 4 through 7).

Figure 4:
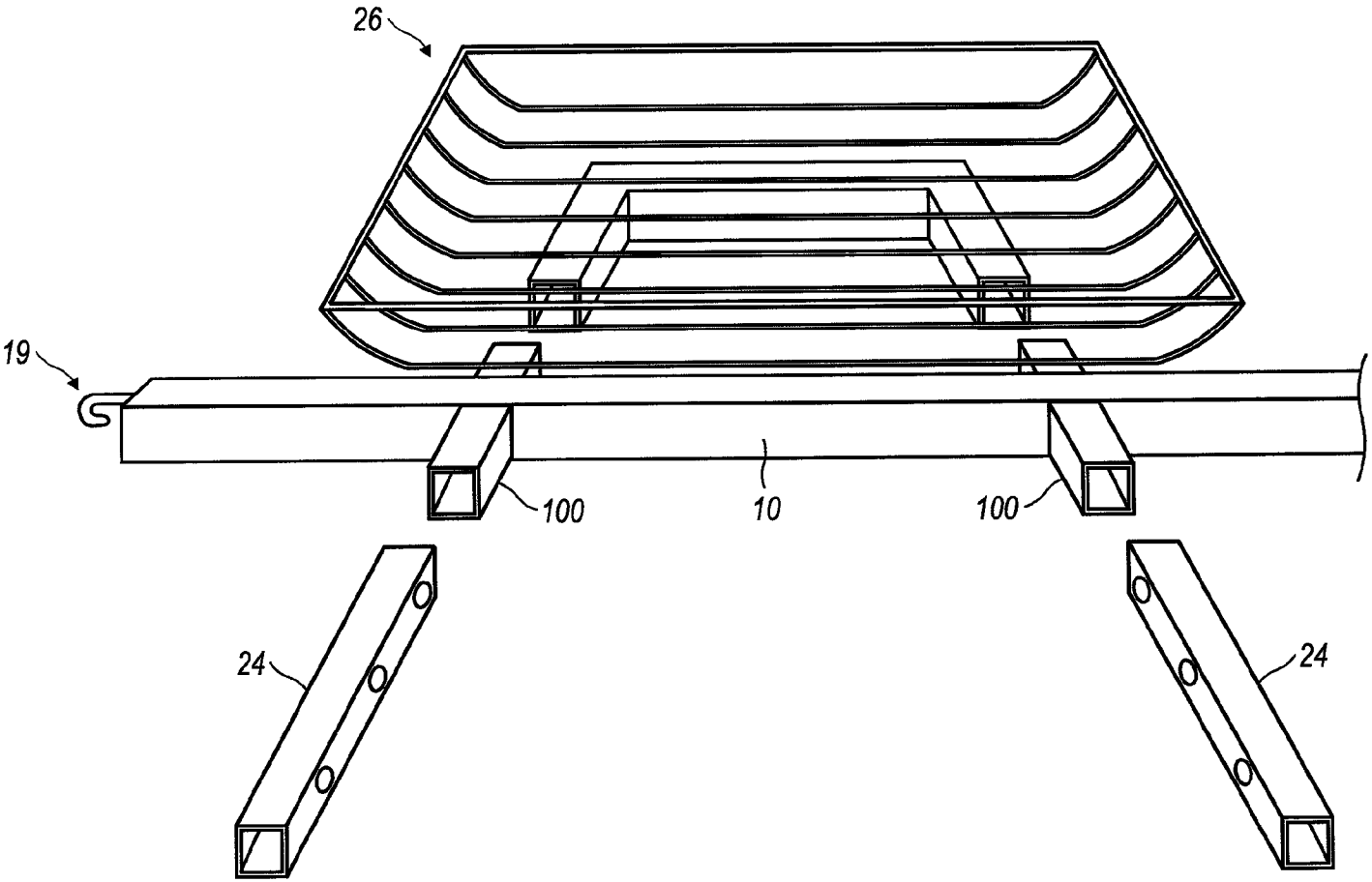
FIG. 4 is a perspective view of embodiments of article holders of the present invention.
Figure 5:
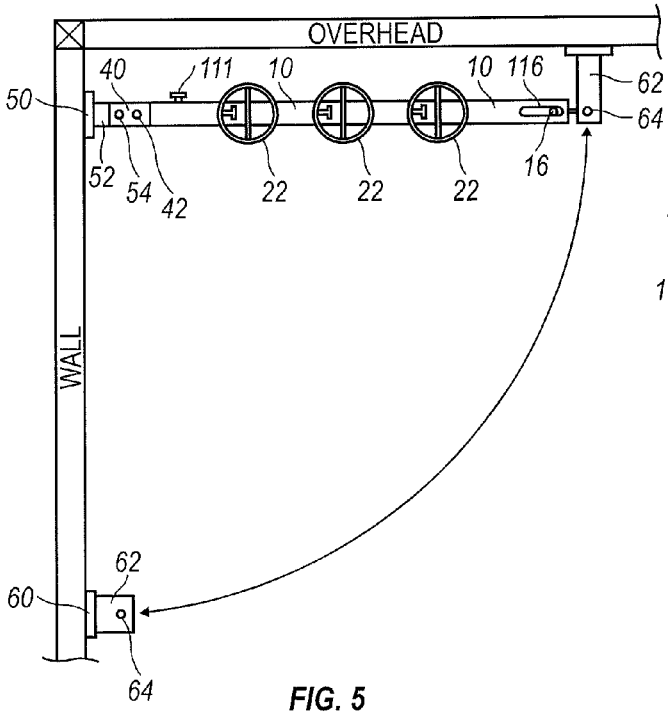
FIG. 5 is a side view of an embodiment of the present invention.
Figure 7:
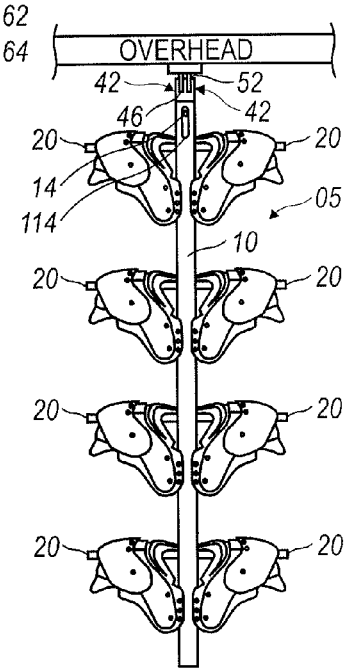
FIG. 7 is a front view of another embodiment of the present invention.

As depicted in FIG. 1, the invention contemplates the releasable fixation of different modular article holders to a common spine 10. Modular article holders can be as in the form of a rest, a grip, container or a combination thereof. The releasably modularity of the article holder to a common spine 10 allows the user to store a wide variety of articles. As depicted in FIGS. 1 and 5, spherical holder 22 is configured to securely hold a sphere—such as a basketball to spine 10. As depicted in FIG. 7, a plurality of rests 20 can be configured to hold athletic equipment upon a common spine 10. FIG. 4 depicts a wire frame basket 26 that can be used to strap in articles. FIG. 4 further depicts a pair of rest with holes 24 to hold elongated articles, such as fishing poles or ski poles on a spine 10. A modular article holder is manufactured from materials suitable for repeated secured holding of an article in an overhead and stacked position on the spine 10. In a preferred embodiment, a plurality of removable rests 20 are manufactured from hollow lightweight aircraft aluminum with a circular cross section.

The upper end region of spine 10 is articularly fixed to an anchor plate 50 (See FIGS. 1, 2 and 5 through 7). Anchor plate 50 is fixed to an overhead surface (See FIGS. 1 and 5 through 7). Fixation of anchor plate 50 can be to a vertical overhead surface (See FIG. 5) or to a horizontal vertical overhead surface (See FIGS. 6 and 7).

Articular fixation of the upper end region of spine 10 to an anchor plate 50 can be accomplished by a simple hinge joint (See FIGS. 1, 2 and 5 through 7), a ball joint or more elaborate articular joints such as a geared hinge (as generally disclosed in U.S. Pat. No. 4,844,057), a positive locking hinge as generally disclosed in U.S. Pat. No. 2,501,581), a clamping pivot hinge (as generally disclosed in U.S. Pat. No. 5,632,066), a ratcheting hinge joint (as generally disclosed in U.S. Pat. No. 5,709,360). In a preferred embodiment, spine 10 is releasably fixed to an anchor plate 50 above, at or below the articular fixation to allow relocation of spine 10.

In a preferred embodiment, an anchor flange 52 extends away from anchor plate 50 and is pivotally fixed to the upper end region of spine 10 by a sliding socket connection located below the articular fixation. See FIGS. 1, 2 and 5 through 7. An upper receiver 40 is pivotally fixed to anchor flange 52 by a pivot rod 54. The upper receiver 40 is distal to the anchor flange 52 and configured to releasably receive a retractable stem 12. The retractable stem 12 is slideably fixed within the upper region of spine 10 to extend beyond or retract into the upper end region of spine 10 along a longitudinal axis of spine 10. Actuation of the retractable stem 12 is accomplished by a stem actuator 14 extending away from the longitudinal axis of spine 10 and projecting through a stem actuator slot 144 formed in the upper region of spine 10. See FIG. 2. Retractable stem 12 fits within upper receiver 40 and is fixed in place by opposing upper pins 42. See FIGS. 1 and 2.

Figure 3:
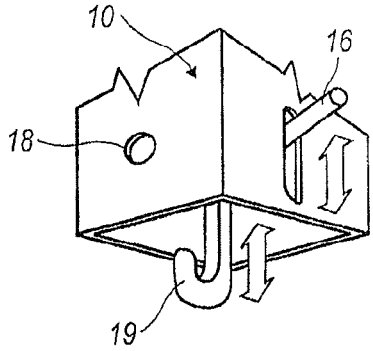
FIG. 3 is a detailed perspective view of a lower region of an embodiment of the present invention.
Figure 6:
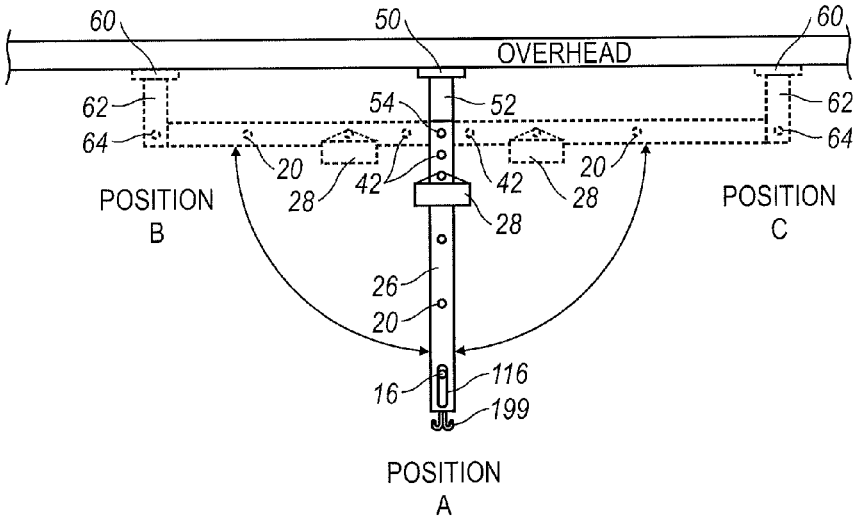
FIG. 6 is a side view of another embodiment of the present invention.

The lower end region of spine 10 is releasably fixed to a foundation plate 60 which in turn is fixed to an overhead surface (See FIGS. 5 and 6). Releaseable fixation of a foundation plate 60 to the lower end region of spine 10 can be accomplished by a mechanical latch, magnetic latch, a slideable hook 19 and rod 64 arrangement as depicted in FIGS. 3, 5 and 6 or a combination thereof. In a preferred embodiment, a retractable hook 19 is slidably fixed within the lower end region of spine 10. Retractable hook 19 extends beyond or retracts into the lower end region of a spine 10 along a longitudinal axis of the spine 10 by a hook actuator 16 which projects through a hook actuator slot 166 formed in the lower end region of spine 10. See FIGS. 1, 3, 5 and 6. The retractable hook 19 engages a foundation rod 64 fixed to a foundation flange 62. Foundation flange 62 is fixed to and projects downward from the foundation plate 60.

In another embodiment, at least a portion of spine 10 rotates about a longitudinal axis of spine 10. In yet another embodiment, the length of spine 10 can be varied by a telescopic joint between said upper and lower end regions of spine 10.

The length of spine 10 is limited only by the distance between the overhead horizontal surface and the ground. It is contemplated that spine 10 is constructed of a lightweight material capable of holding, at a minimum, the total weight of the spine 10, article holders and the articles 01 intended to be stored without significant flexing. It is contemplated that a spine 20 can be of any cross sectional form, hollow, solid or a combination of both and manufactured from metallic, plastic, composite or a combination of these materials. In a preferred embodiment, spine 20 is manufactured from hollow lightweight aircraft aluminum with a circular cross section.

In a preferred embodiment, lower end region of spine 10 is releaseably connected to a stand 30 in contact with the ground. It is contemplated that stand 30 can be in wheeled contact with the ground to allow the spine 10 to be moved about the ground. In a preferred embodiment, releasable connection of lower end region of spine 10 to stand 30 is achieved through the use of a base receiver 34 mounted to stand 30 and projecting upwards to receive a portion of lower end region of spine 10 to allow spine 10 to remain in a generally vertical position when spine 10 is detached from anchor plate 50. The lower end region of spine 10 is releaseably fixed to base receiver 34.

In yet another embodiment, retractable hook 19 is fitted with a second hook to form a double hook 199. See FIG. 6. Double hook 199 releasably connected to a second foundation plate 60 allows spine 10 to be swung to/from a vertical position (depicted in FIG. 6 as "Position A") to/from two horizontal positions (depicted in FIG. 6 as "Position B" and "Position C").

It is understood that the preceding description is given merely by way of illustration and not in limitation of the invention and that various modifications may be made thereto without departing from the spirit of the invention as claimed.

I claim:

1. An articulating modular storage system comprising:

a spine of a length no greater than the distance between an overhead surface and the ground, said spine comprising an upper end region and a lower end region;

a stub extending from said spine between said upper end region and said lower end region, said stub releasably receives an article holder wherein said article holder is in contact with at least a part of an article to store the article;

a retractable stem slideably fixed within said upper end region, wherein said retractable stem extends beyond or retracts into said upper end region along a longitudinal axis extending through said upper and lower end regions of said spine by a stem actuator extending away from said longitudinal axis and projecting through a stem actuator slot formed in said upper end region;

a retractable hook slideably fixed within said lower end region, wherein said retractable hook extends beyond or retracts into said lower end region along said longitudinal axis by a hook actuator extending away from said longitudinal axis and projecting through a hook actuator slot formed in said lower end region;

an anchor plate fixed to said overhead surface, and an anchor flange fixed to and projecting downward from said anchor plate;

an upper receiver pivotally fixed to said anchor flange by a pivot rod, wherein said upper receiver is distal to said anchor flange and configured to releasably receive said retractable stem to allow articulation of said spine about said pivot rod;

a foundation plate fixed to said overhead surface, and a foundation flange fixed to and projecting downward from said foundation plate;

a foundation rod fixed to said foundation flange and configured to releasably receive said retractable hook to hold said spine in a generally overhead position;

an opposing hook fixed in opposition to said retractable hook to form a retractable double hook, wherein said opposing hook extends beyond or retracts into said lower end region of said spine by said hook actuator;

a second foundation plate fixed to said overhead surface, and a second foundation flange fixed to and projecting downward from said second foundation plate; and a second foundation rod fixed to said second foundation flange and configured to releasably receive said opposing hook to hold said spine in a second generally overhead position.

2. The articulating modular storage system as claimed in claim 1, wherein said article holder is selected from the group comprising a spherical holder, basket, pivoting basket or a combination thereof is releasably fixed to said spine.

3. The articulating modular storage system for articles as claimed in claim 1, further comprising a base receiver fixed to and projecting up from a floor stand, wherein a portion of said lower end region of said spine fits within and is releasably fixed to said base receiver to allow said spine to remain in said generally vertical position when said spine is detached from said anchor plate.

* * * * *